United States Patent [19]

Raible et al.

[11] Patent Number: 4,954,055

[45] Date of Patent: Sep. 4, 1990

[54] VARIABLE ROLLER PUMP TUBING

[75] Inventors: Donald A. Raible, Santa Ana; William K. Morrow, San Clemente, both of Calif.

[73] Assignee: Baxter International, Inc., Deerfield, Ill.

[21] Appl. No.: 369,806

[22] Filed: Jun. 22, 1989

[51] Int. Cl.[5] ..... F04B 43/12

[52] U.S. Cl. ..... 417/477; 417/474; 138/109; 138/118; 138/119; 138/177; 138/178; 604/153

[58] Field of Search ..... 417/474–479; 138/109, 118, 119, 177, 178; 604/153; 251/6; 428/36.9, 36.92

[56] References Cited

U.S. PATENT DOCUMENTS

| | | | |
|---|---|---|---|
| Re. 25,788 | 6/1965 | Sheridan | 138/109 X |
| Re. 29,331 | 8/1977 | Naito | 138/118 |
| 3,046,903 | 7/1962 | Jones . | |
| 3,175,498 | 3/1965 | Rohrer | 417/474 |
| 4,031,745 | 6/1977 | McCarty | 138/109 X |
| 4,347,874 | 9/1982 | Sullivan et al. . | |
| 4,499,045 | 2/1985 | Obsomer . | |
| 4,515,536 | 5/1985 | Van O's | 138/119 X |
| 4,781,548 | 11/1988 | Alderson et al. | 604/153 X |
| 4,790,356 | 12/1988 | Tash | 138/177 X |

FOREIGN PATENT DOCUMENTS

| | | | |
|---|---|---|---|
| 1252315 | 12/1960 | France | 138/109 |
| 0039532 | 3/1957 | Poland | 417/474 |
| 0547551 | 5/1977 | U.S.S.R. | 417/476 |
| 0453807 | 9/1936 | United Kingdom | 417/474 |

*Primary Examiner*—Leonard E. Smith
*Assistant Examiner*—Eugene L. Szczecina, Jr.
*Attorney, Agent, or Firm*—Michael C. Schiffer

[57] ABSTRACT

A variable diameter tube for use with a roller pump which is formed with a central large diameter section that is positioned in the roller pump raceway. This tube is formed with two end portions of substantially similar internal diameter with the diameter of the tube gradually increasing towards the central section. The gradual increase in diameter is no greater than about thirty degrees per inch and the wall thickness of the tubing wall is substantially equivalent along its entire length.

4 Claims, 1 Drawing Sheet

VARIABLE ROLLER PUMP TUBING

BACKGROUND OF THE INVENTION

The present invention relates to blood roller pumps, and particularly to the blood tubing used with such roller pumps.

Roller pumps are specifically used to pump blood through an extracorporeal circuit. These types of pumps are formed with a generally circular raceway into which a blood compatible tubing is fixed. The tubing includes inlet and outlet ends. The pumps also include one or more rollers. These rollers are rotatably mounted to the ends of individual arms, which rotate about a common axis to direct the rollers along the pump raceway. The pumping action is obtained by the compressing of the tubing as the rollers are pushed along the raceway. An example of a roller pump is the Sarns 7000.

The pumping rate achieved by roller pumps is dependent upon the size of the tubing held within the raceway, and/or the rate of compression applied by the pressure rollers. Faster rotation rates increase the rate of compression of the tubing. This increased compression can lead to greater hemolysis. It is thus more desireable to increase the pump rate by increasing the diameter of the tubing in the pump raceway. A limitation on the diameter of the raceway tubing is the diameter of the tubing in the remainder of the circuit, which is constrained by the size of the other elements positioned in the raceway.

One alternative suggested by various workers is the positioning of a larger diameter tube or bulb in the pump raceway which is coupled to the smaller diameter tubing comprising the circuit by suitable connectors. Examples of such arrangements are disclosed in U.S. Pat. Nos. 3,046,903, issued to Jones on July 31, 1962; and 4,347,874, issued to Sullivan et al on Sept. 7, 1982.

The disadvantage with such arrangements is the sharp surfaces provided by the connectors. Hemolysis occurs as the blood passes through such connectors. It would be highly desirable to provide for a continuous length of tubing having a larger internal diameter for placement in the pump raceway.

Single tubes having section of differing diameters haven been used in other types of fluid pumps, and specifically in peristaltic pumps. For example, see U.S. patent application Ser. No. 830,693, filed on Feb. 18, 1986, entitled COLLAPSIBLE CONDUIT FOR LINEAR PERISTALTIC PUMP AND METHOD OF MAKING SAME, which is assigned to the same assignee of the instant application. The major disadvantage to the disclosed tube is the required thin wall portion which is placed in the pump.

Peristaltic pumps include a tube positioned in a chamber partially defined by a series of reciprocating cams. The operation of the peristaltic pump involves the sequential receiprocation of the cams to laterally compress the tube. As stated, roller pumps operate by compressing a tube positioned in the pump raceway by the action of revolving rollers. The tube is slightly stretched as the rollers are passed along the tube. It has been discovered that this slight stretching action damages the thin walled portion of the tube described in the previously mentioned application.

The formation of a unitary tube having more than one diameter is disclosed in U.S. Pat. No. 4,499,045, issued to Obsomer on Feb. 12, 1985. This patent discloses a process whereby a tube is heated and then compressed inwardly into a chamber. The inward compression allows the tube to laterally expand while maintaining the molecular orientation of the plastic forming the tube. The overall length of the tube is constrained by the size of the mold into which the tube is compressed. Furthermore, the resulting tube possesses sharp surfaces which presents the same problems associated with the interconnecting of two different diametered tubes.

SUMMARY OF THE INVENTION

The present invention overcomes the above discussed disadvantages by providing a variable diameter tube having a larger central section positioned in the roller pump raceway. This central section that gradually decreases in diameter in a direction towards the ends of the tubing. Specifically, the variable diameter tube is formed with two end portions of similar internal diameter. The tubing gradually increases in diameter towards the central section. The gradual increase in diameter is no greater than about thirty degrees per inch and the wall thickness of the tubing wall is substantially equivalent along it entire length.

DESCRIPTION OF THE DRAWINGS

The present invention may be better understood and the advantages will become apparent to those skilled in the art by reference to the accompanying drawings, wherein like reference numerals refer to like elements in the several figures, and wherein.

DESCRIPTION OF THE PREFERRED EMBODIMENTS

The present invention is directed to a variable diameter tube used in a roller pump. This tube is formed with a central section having an internal diameter greater than the remainder of the tube. In forming the tube of the invention care is taken to provide that the resulting wall will have a substantially constant thickness and that the diameter of the tube leading to the central portion gradually increases to form a tapered zone.

This gradual diameter increase has been found critical to minimize hemolysis as the blood is being forced through the tube. It has been determined that this diameter increase should be no greater than about 30° per inch, preferably from about 2° to about 15° per inch.

The variable diameter tubes of the invention are prepared from any suitable polymeric material preferably a polyvinyl chloride polymer having a Shore hardness of A 70.

Figure 2:
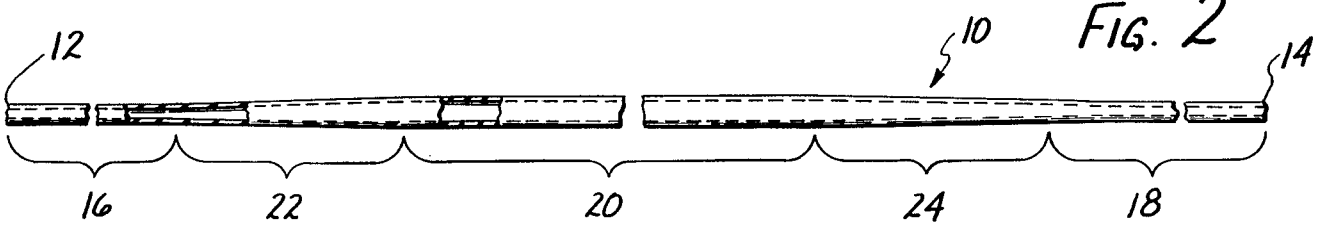
FIG. 2 is a side prospective view of a variable diameter tube in accordance with an embodiment of the invention.

Referring now to FIG. 2, a partially sectioned prospective view of tube in accordance with the invention is seen generally at 10. Tube 10 is an elongated cylindrical body having two opposing ends 12 and 14. These portions, which are generally known as end portions 16 and 18, for a descrete portion of the overall length of the tube 10. End portions 16 and 18 generally possess similar internal diameters. Situated between these end portions 16 and 18 is the central section 20. The internal diameter of central section 20 is larger than the end portions 16 and 18.

The tube 10 is further formed with two intermediate portions 22 and 24. These portions 22 and 24 lie respectively between the end portions 16 and 18 and the central section 20. These portions 22 and 24 define the tappering zone of the tube 10 which gradually increases in diameter from the end portions 16 and 18 to the central section 20. These tapered portions 22 and 24 gradually increase in diameter in a direction toward the central section 20. The degree of tapering is sufficiently gradual to minimize hemolysis as blood travels through the tube 10. As stated this tapering should be no greater than about 30° per inch, preferably from about 2° to about 15° per inch.

The tube 10 is formed to ensure that the wall 26 remains substantially constant through the central section 20, end portions 16 and 18 and tapered portions 22 and 24.

The tube 10 may be formed by any conventional method, but preferably is formed by extrusion. Extrusion techniques are well known with the puller rate, temperature of the polymer and the air pressure exerted inside the forming tube controlled to provide the above described tapering.

Various embodiments of the invention variable tubings were formed. One example included end portions 16 and 18 having an internal diameter of $\frac{3}{8}$ inch and an central section 20 having $\frac{1}{2}$ inch internal diameter. In another example the end portions 16 and 18 were of $\frac{3}{8}$ of an inch internal diameter with the central section 20 having $\frac{5}{8}$ inch internal diameter. A still further example provided end portions 16 and 18 with a $\frac{1}{4}$ inch internal diameter and an central section 20 with $\frac{3}{8}$ inch internal diameter. The tapered portions 22 and 24 had a 3° per inch taper.

The general length of the tapered portions 22 and 24 in each of the above examples was fourteen inches with the central section 20 having a length of around 24 inches. The length of the end portions 16 and 18 varied with respect to each other and from example to example.

The wall thickness of the tube 10 in each example was about 0.093 inches.

Figure 1:
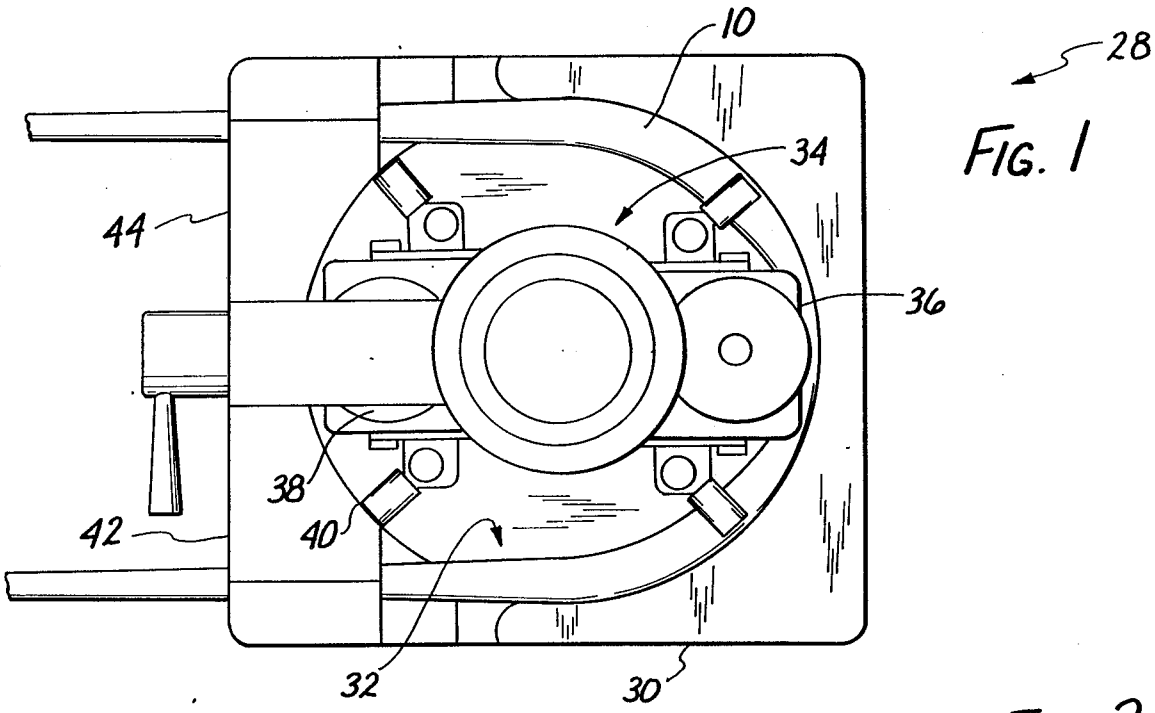
FIG. 1 is a partially sectioned view of a roller pump head illustrating the placement of the larger central portion of a variable diameter tube in accordance with an embodiment of the invention.

Referring now to FIG. 1, a pump head 28 is illustrated with the tube 10 in the raceway. Roller pumps are generally well known in the art with the pump head 28 seen in FIG. 2 being that of a model 7000 Roller Pump manufactured and sold by the Sarns Corporation of Ann Arbor, Michigan. Accordingly pump head 28 is not critical to the invention and will not be described in any great detail herein.

Generally, pump head 28 includes a housing 30 which is formed with a circular opening 32. Positioned in this circular opening 32 is the roller assembly 34. Roller assembly 34 includes two oppositely positioned rollers 36 and 38 and four equally distant positioned guide assemblies 40. The pump head 28 raceway is defined by the walls of the housing 30 defining the circular opening 32 and the guide assemblies 40.

The tube 10 is placed through two tube clamp assemblies 42 and 44, with the larger central section 20 situated in the pump head 28 raceway. These tube clamp assemblies 42 and 44 are opened outward from the housing 30 and closed down upon the tube 10. The operation of the tube clamp assemblies 42 and 44 will not be described any further herein.

The roller assembly 34 is rotated within the circular opening 32 in either clockwise or counter clockwise direction. The individual rollers 36 and 38 press radially outward against the tube 10 as the roller assembly 34 rotates within the circular opening 32. The tube 10 is dimensioned to position substantially only the central section 20 within the pump head 28. The tapered portions 22 and 24 and the end portions 16 and 18 will extend out of the pump head 28 beyond the tube clamp assemblies 42 and 44. Thus the precise length of the respective end portions 16 and 18 is not critical to the invention, but the actual length of the central section 20 is critical to allow for the appropriate positioning of this section within the pump head 28 raceway.

While the preferred embodiments have been described, various modifications and substitutions may be made thereto without departing from the scope of the invention. Accordingly, it is to be understood that the invention has been described by way of illustration and not limitation.

What is claimed is:

1. A roller pump assembly comprising:

a pump head assembly having a tube raceway along which one or more pump rollers travel; and a variable diameter tubing having a substantially constant wall thickness situated which is formed with two end portions having substantially similar internal diameters and a central larger diameter section situated between said two end portions, said larger diameter central section gradually increasing in diameter from each of said end portions, with said gradual increase in diameter being at a rate of no greater than about thirty degrees per inch, and wherein said tubing central section is dimensioned to lie substantially along the entire length of said raceway.

2. A variable diameter tube for positioning along a raceway of a roller pump assembly comprising:

a tube having a substantially constant wall thickness formed with two end portions of substantially similar internal diameter and a section formed intermediate said two end portions having a larger internal diameter, which intermediate section is dimensioned to lie along substantially the entire length of said pump raceway, said end portions and said central sections being joined by an intermediate portion which gradually increases in diameter from said end portions to said central section at a rate of no greater than about thirty degrees per inch.

3. The roller pump assembly of claim 1 wherein said gradual tapering is from about 2° to about 15° per inch.

4. The roller pump assembly of claim 2 wherein said gradual tapering is from about 2° to about 15° per inch.

* * * * *